US006577995B1

(12) United States Patent
Kim et al.

(10) Patent No.: US 6,577,995 B1
(45) Date of Patent: Jun. 10, 2003

(54) APPARATUS FOR QUANTIZING PHASE OF SPEECH SIGNAL USING PERCEPTUAL WEIGHTING FUNCTION AND METHOD THEREFOR

(75) Inventors: Doh-suk Kim, Yongin (KR); Moo-young Kim, Yongin (KR)

(73) Assignee: Samsung Electronics Co., Ltd. (KR)

( * ) Notice: Subject to any disclaimer, the term of this patent is extended or adjusted under 35 U.S.C. 154(b) by 428 days.

(21) Appl. No.: 09/672,973

(22) Filed: Sep. 29, 2000

(30) Foreign Application Priority Data

May 16, 2000 (KR) ..... 2000-26180

(51) Int. Cl.[7] ..... G10L 19/02

(52) U.S. Cl. ..... 704/230; 704/220.1; 704/203; 704/207

(58) Field of Search ..... 704/200.1, 203, 704/207, 230

(56) References Cited

U.S. PATENT DOCUMENTS 5,388,181 A 2/1995 Anderson et al.
6,292,777 B1 * 9/2001 Inoue et al. ..... 704/230

FOREIGN PATENT DOCUMENTS

EP 0 709 827 1/1996
EP 0910067 A 4/1999

OTHER PUBLICATIONS

Dou–suk Kim et al., "On the Perceptual Weighting Function for Phase Quantization of Speech", 2000 IEEE Workshop on Speech Coding, Sep. 2000, pp. 62–64.

M. Kohata, "1.2 kbit/s harmonic coder using auditory filters", *Proceedings of the 1999 IEEE International Conference on Acoustics, Speech & Signal Processing*, vol. 1, pp. 469–472, Mar. 15, 1999.

O. Gottesmann, "Dispersion phase vector quantization for enhancement of waveform interpolative coder", *Proceedings of the 1999 IEEE International Conference on Acoustics, Speech & Signal Processing*, vol. 1, pp. 269–272, Mar. 15, 1999.

Pobloth et al, "On phase perception in speech", *Proceedings of the 1999 IEEE International Conference on Acoustics, Speech & Signal Processing*, vol. 1, pp. 29–32, Mar. 15, 1999.

* cited by examiner

*Primary Examiner*—Tālivaldis Ivars Šmits
(74) *Attorney, Agent, or Firm*—Burns, Doane, Swecker & Mathis, L.L.P.

(57) ABSTRACT

An apparatus for quantizing the phase of a speech signal using a perceptual weighting function and a method therefor are provided. The apparatus for quantizing the phase of a speech signal using a perceptual weighting function includes a phase information extractor for obtaining the phase of each harmonic frequency in a speech signal represented by the discrete sum of periodic signals having different harmonic frequency components, a quantization noise shaping unit for controlling the amount of quantization noise of each phase using a perceptual weighting function, which makes quantization noise less than a predetermined just noticeable difference (JND) of the phase, a quantization bit assigner for assigning quantization bits to each phase according to the controlled amount of quantization noise, and a scalar quantizer for quantizing each phase by the assigned quantization bits. It is possible to improve the quality of encoded speech by quantizing phase information using a perceptual weighting function.

8 Claims, 7 Drawing Sheets

APPARATUS FOR QUANTIZING PHASE OF SPEECH SIGNAL USING PERCEPTUAL WEIGHTING FUNCTION AND METHOD THEREFOR

RELATED APPLICATIONS

This application is related to copending patent application, Ser. No. 09/571,417, titled "Device for Processing Phase Information of Acoustic Signal and Method Thereof," filed on May 15, 2000.

BACKGROUND OF THE INVENTION

1. Field of the Invention

The present invention relates to quantization of the phase of a speech signal, and more particularly, to an apparatus for quantizing the phase of a speech signal using a perceptual weighting function and a method therefor.

2. Description of the Related Art

It is essential to refer to the perceptual characteristics of the human auditory to system with respect to the spectrum of a speech signal in speech encoding systems. However, little attention has been paid to the perceptual characteristics of phase information. Recently, some interesting research addressing the importance of the perceptual characteristics of phase information in a speech signal has been conducted. It has been shown that humans' ability to distinguish different phase spectra is better than is often assumed.

In an apparatus for processing information on the phase of a speech signal disclosed in application Ser. No. 09/571,417 filed by the present applicant, a criterion was proposed to determine perceptually irrelevant phase information in a stationary section of a speech signal in the context of frequency domain representation of the speech signal. For harmonic signals, the criterion leads to the "critical phase frequency", below which phase information is irrelevant to the perceived quality of the signal. As mentioned above, the speech signal phase information processing apparatus for distinguishing an important phase component was provided considering human auditory characteristics, so that the phase component of the speech signal is selectively coded or composed. However, there remain many problems to be solved in order to more effectively quantize the phase information.

One of them is how to effectively quantize the phase information above the critical phase frequency using the perceptual characteristics. In the present invention, use of the perceptual characteristics of the human auditory system for quantizing the phase of the speech signal will be provided.

SUMMARY OF THE INVENTION

To solve the above problems, it is an object of the present invention to provide an apparatus for quantizing the phase of a speech signal, which is capable of improving the quality of encoded speech by quantizing phase information using a perceptual weighting function, which makes phase quantization noise of a speech signal less than a predetermined just noticeable difference (JND) of phase, and a method therefor.

Accordingly, to achieve the above object, according to an aspect of the present invention, there is provided an apparatus for quantizing the phase of a speech signal using a perceptual weighting function, comprising a phase information extractor for obtaining the phase of each harmonic frequency in a speech signal represented by the discrete sum of periodic signals having different harmonic frequency components, a quantization noise shaping unit for controlling the amount of quantization noise of each phase using a perceptual weighting function, which makes quantization noise less than a predetermined just noticeable difference (JND) of the phase, a quantization bit assigner for assigning quantization bits to each phase according to the controlled amount of quantization noise, and a scalar quantizer for quantizing each phase by the assigned quantization bits.

According to another aspect of the present invention, there is provided another apparatus for quantizing the phase of a speech signal using a perceptual weighting function, comprising a phase information extractor for obtaining the phase of each harmonic frequency in a speech signal represented by the discrete sum of periodic signals having different harmonic frequency components, a perceptual weighting function calculator for calculating a perceptual weighting function using a result obtained by measuring the JND of the phase at each harmonic frequency for a harmonic tone having the fundamental frequency of the speech signal, a comparator for comparing a previously provided quantization estimation codebook with each phase by applying the perceptual weighting function, and a minimum value detector for detecting the minimum value among comparison values sequentially obtained from the comparator and outputting the index of the quantization estimation code book corresponding to the minimum value.

To achieve the above object, according to an aspect of the present invention, there is provided a method for quantizing the phase of a speech signal using a perceptual weighting function, comprising the steps of (a) obtaining the phase of each harmonic frequency in a speech signal represented by the discrete sum of periodic signals having different harmonic frequency components, (b) calculating a perceptual weighting function using a result obtained by the JND of the phase at each harmonic frequency for a harmonic tone having the fundamental frequency of the speech signal, (c) controlling the amount of quantization noise of each phase by calculating the amount of quantization noise from the perceptual weighting function of each phase, (d) assigning quantization bits to each phase according to the controlled amount of quantization noise, and (e) quantizing each phase by the assigned quantization bits.

According to another aspect of the present invention, there is provided a method for quantizing the phase of a speech signal using a perceptual weighting function, comprising the steps of (a) obtaining the phase of each harmonic frequency in a speech signal represented by the discrete sum of periodic signals having different harmonic frequency components, (b) calculating a perceptual weighting function using the result obtained by measuring the JND of a phase at each harmonic frequency for a harmonic tone having the fundamental frequency of the speech signal, (c) comparing a previously provided quantization estimation code book with each phase by applying the perceptual weighting function, and (d) detecting the minimum value among the comparison values sequentially obtained in the step (d) and outputting the index of the quantization estimation code book corresponding to the minimum value.

BRIEF DESCRIPTION OF THE DRAWING(S)

The above object and advantages of the present invention will become more apparent by describing in detail a preferred embodiment thereof with reference to the attached drawings in which.

DESCRIPTION OF THE PREFERRED EMBODIMENT

Figure 1:
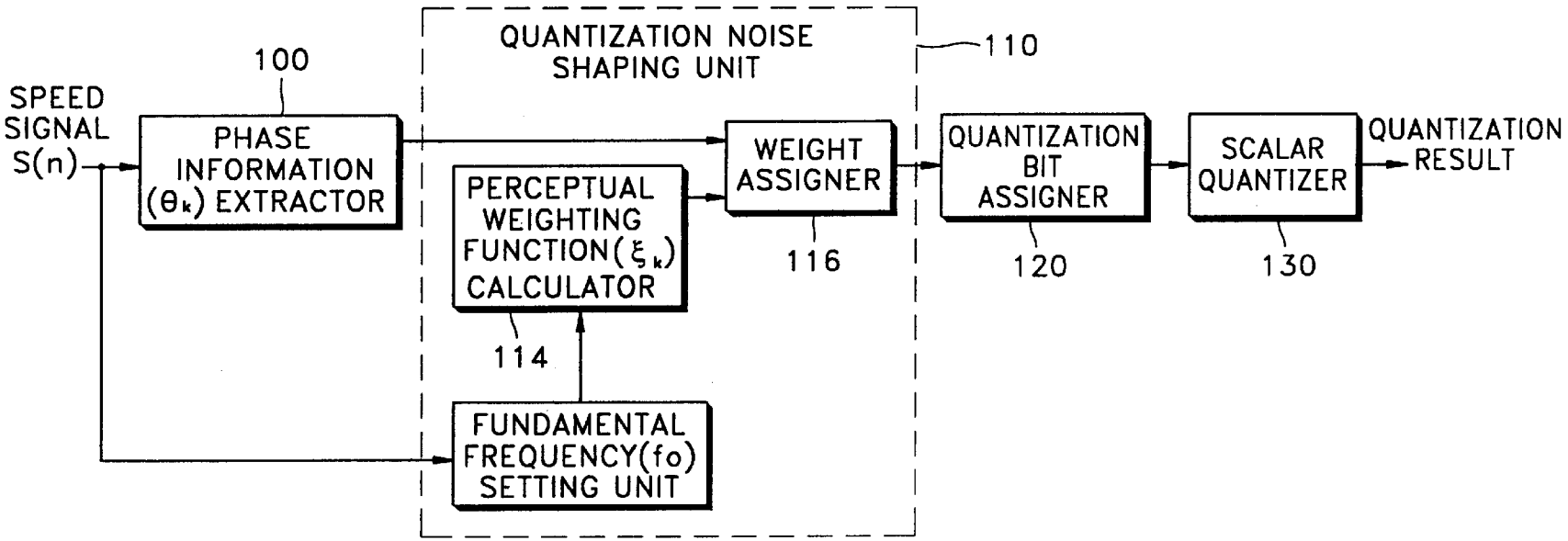
FIG. 1 is a block diagram for describing a phase quantization apparatus according to the present invention for scalar quantization.

FIG. 1 is a block diagram for describing a phase quantization apparatus according to the present invention for scalar quantization. The phase quantization apparatus includes a phase information extractor 100, a quantization noise shaping unit 110, a quantization bit assigner 120, and a scalar quantizer 130. The quantization noise shaping unit 110 includes a fundamental frequency setting unit 112, a perceptual weighting function calculator 114, and a weight assigner 116.

Figure 3:
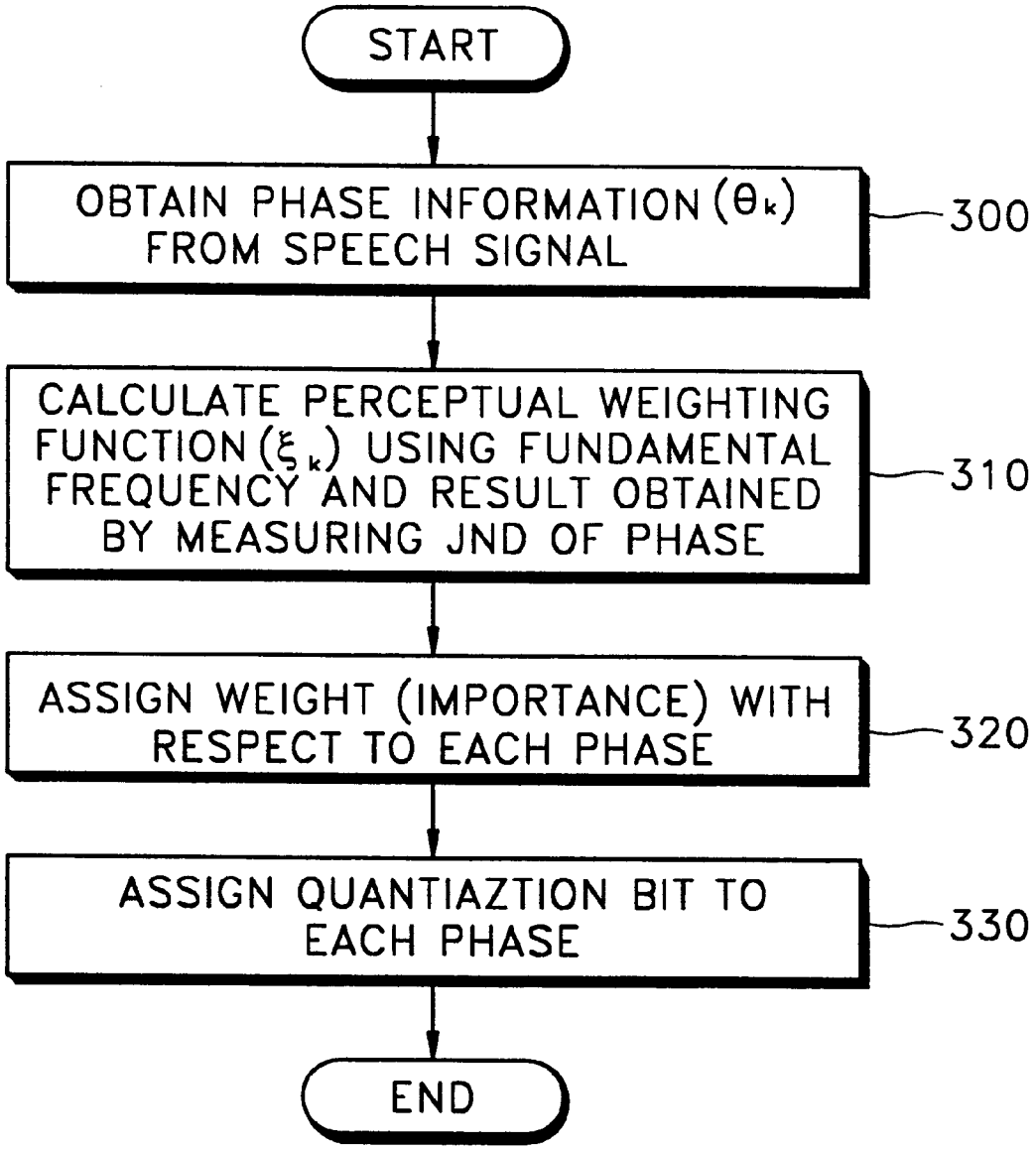
FIG. 3 is a flowchart for describing a phase quantization method according to the present invention.
Figure 4A:
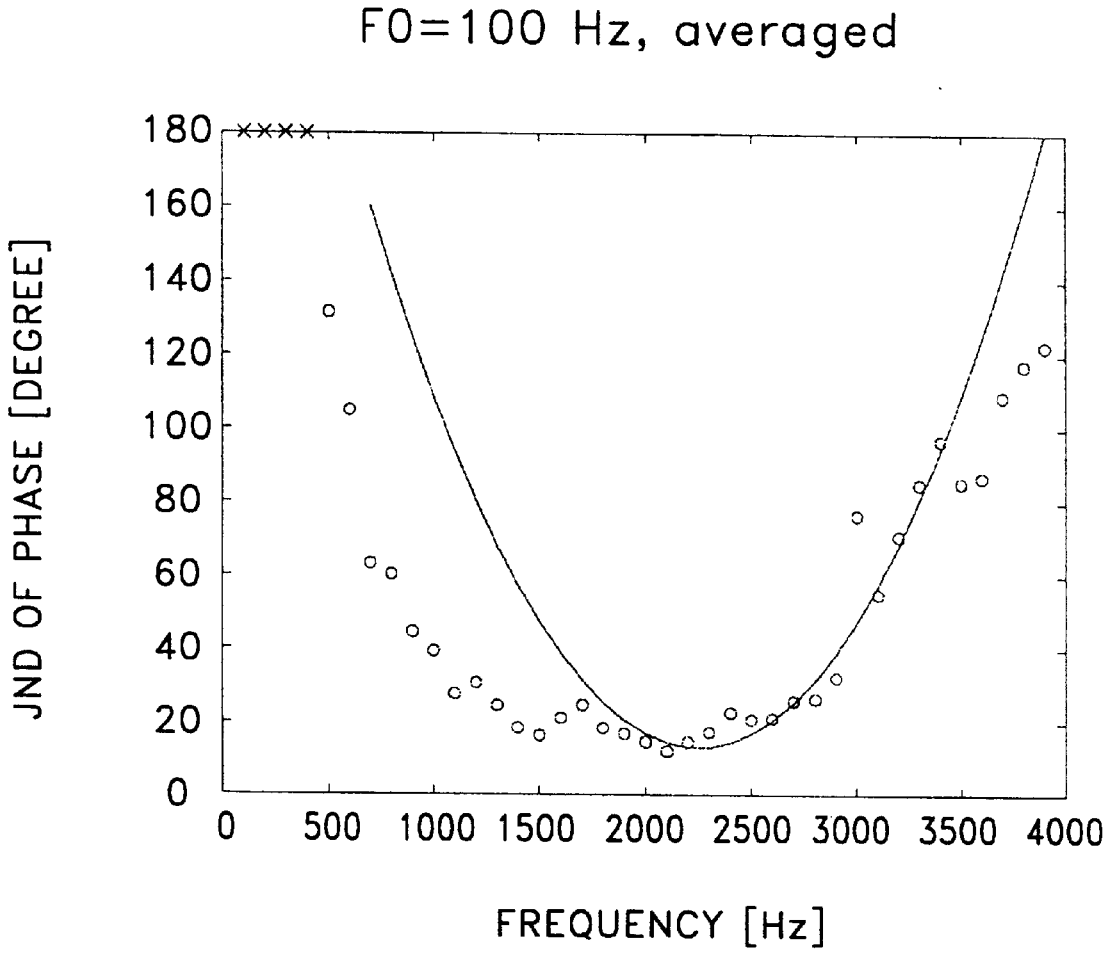
FIGS. 4A through 4D show an experimental example of a just noticeable difference (JND) of phase according to the present invention.
Figure 4B:
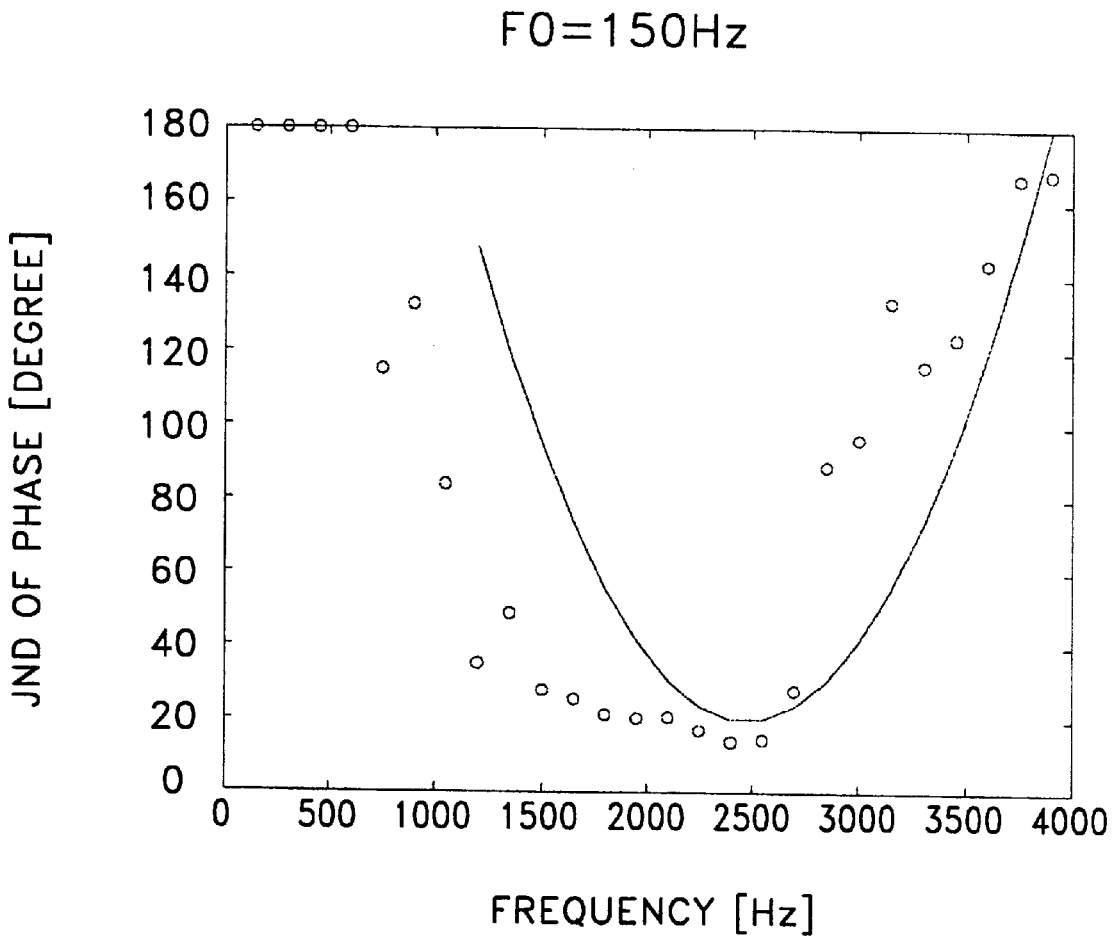
Figure 4C:
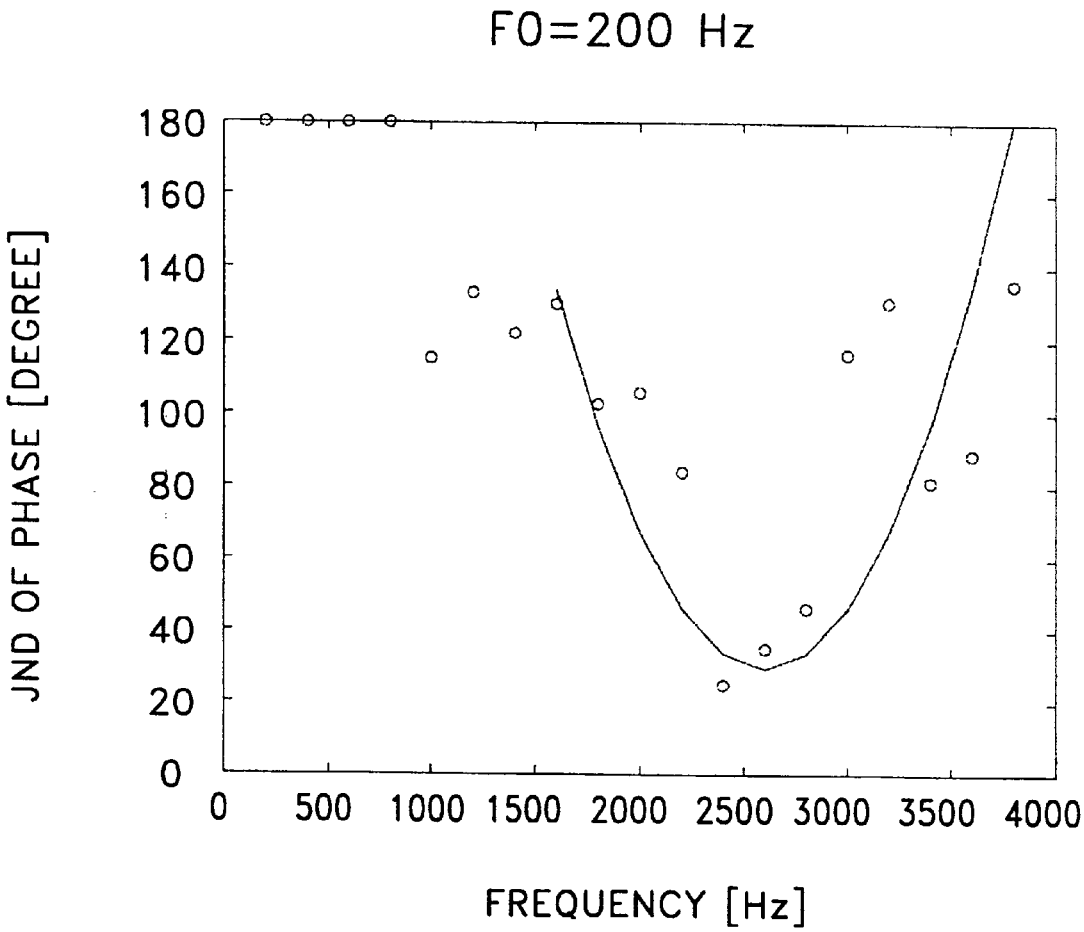
Figure 4D:
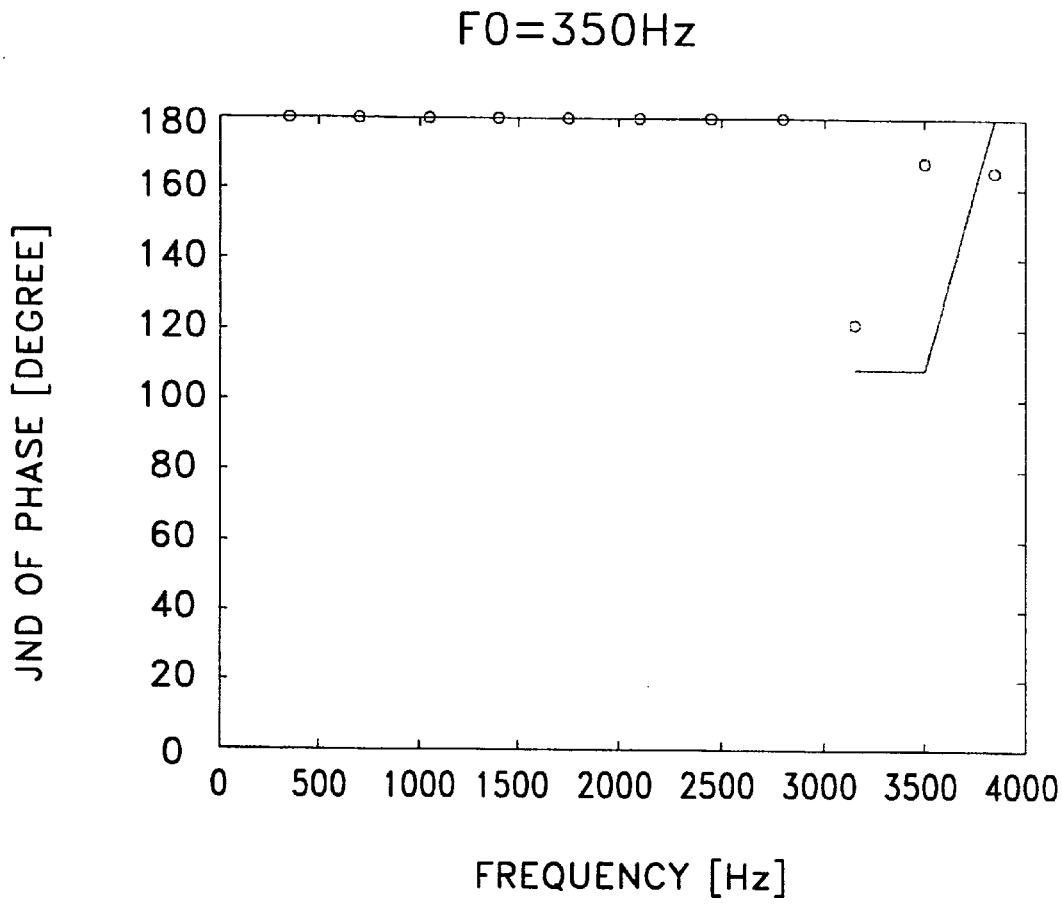

FIG. 3 is a flowchart for describing a phase quantization method according to the present invention. The operation of the apparatus shown in FIG. 1 will be described in detail with reference to FIG. 3.

The phase information extractor 100 obtains phase information from a speech signal to be quantized (step 300). A speech signal s(n) can be represented by Equation 1 in a harmonic speech encoding system, $$s(n) = \sum_k A_k \cos(k\omega_0 n + \theta_k) \tag{1}$$

wherein, $A_k$, $\omega_0$, and $\theta_k$ represent a spectral magnitude, a fundamental frequency, and a phase, at a kth harmonic frequency, respectively. That is, the speech signal s(n) is represented as the discrete sum of periodic signals having different harmonic frequency components.

The quantized phase $Q(\theta_k)$ of the kth harmonic frequency is represented by Equation 2, $$Q(\theta_k)=\theta_k+\epsilon \tag{2}$$

wherein, $\epsilon$ represents quantization noise. When it is assumed that a quantization noise source is stationary white noise with a uniform distribution over a quantization interval and that the quantization noise is uncorrelated with an input, the variance of the quantization noise is represented by Equation 3, $$\sigma_\varepsilon^2 = \frac{1}{3}\left(\frac{\Delta}{2}\right)^2 \tag{3}$$

wherein, $\Delta$ represents the size of a quantization step. In the case where scalar quantization is performed with respect to the phase of each harmonic frequency, when it is assumed that the number of quantization bits assigned to represent each phase is B over the entire harmonic frequency, $2^B=2\pi/\Delta$. At this time, the total number of bits $B_{tot}$ for quantizing K phase components is represented by $\Delta$ as shown in Equation 4.

$$B_{tot}=KB=K\log_2(2\pi/\Delta) \tag{4}$$

In the present invention, in order to make a quantized signal perceptually more adjacent to an original signal, the above-mentioned uniform quantization noise is shaped with respect to each phase using a perceptual weighting function at each harmonic frequency. At this time, in the quantization apparatus and method according to the present invention, more bits are assigned to perceptually important phase components, while keeping the total number of bits for all phase components the same as that in the case where the quantization noise is uniform.

Referring to FIGS. 1 and 3, the quantization noise shaping unit 110 controls the quantization step size of each phase using a perceptual weighting function, which makes the quantization noise less than a predetermined just noticeable difference (JND) of phase. The JND obtained through a human-being oriented experiment represents the lowest level of quantization noise at which a change in phase is detectable by human ears. That is, human-beings sense the change in phase when the quantization noise is equal to or more than the JND.

A way of controlling the magnitude of the quantization noise using the perceptual weighting function will now be described.

According to Equation 3, the quantization noise is correlated with the quantization step, and the quantization step size varies according to each harmonic frequency. The quantization step size at the kth harmonic frequency is represented by Equation 5, $$\Delta_k=v\xi_k \tag{5}$$

wherein, $\xi_k$ represents a perceptual weighting function, and a smaller $\xi_k$ indicates that a phase is perceptually more important. If the number of quantization bits for the phase $\theta_k$ is referred to as $B_k$, the total number of bits required to quantize K phase components can be represented by Equation 6 by making the total number of bits for all phase components equal to that of Equation 4 as mentioned above, $$B_{tot} = \sum_{k=1}^{K} B_k = \sum_{k=1}^{K} \log_2(2\pi/\Delta_k) = K\log_2(2\pi/\Delta) \tag{6}$$

Putting Equation 5 into Equation 6 leads to Equation 7, $$v^K = \frac{\Delta^K}{\prod_{i=1}^{K} \xi_i} \tag{7}$$

Finally, the variance of quantization noise of the phase at the kth harmonic frequency is represented by Equation 8, $$\sigma_k^2 = \frac{1}{3}\left(\frac{\Delta_k}{2}\right)^2 \tag{8}$$

wherein, the quantization step size for the phase $\theta_k$ is represented by Equation 9, $$\Delta_k = \frac{\xi_k}{\sqrt[K]{\prod_{i=1}^{K} \xi_i}}\Delta \tag{9}$$

It is noted from Equation 9 that the amount of quantization noise is controlled using the perceptual weighting function.

In the quantization noise shaping unit 110, the fundamental frequency setting unit 112 obtains a fundamental frequency from the speech signal represented by Equation 1.

The perceptual weighting function calculator 114 calculates the perceptual weighting function using the result obtained by measuring the just noticeable difference (JND) of the phase at each harmonic frequency with respect to a harmonic tone having a fundamental frequency (step 310). The JND is a psychoacoustic term, which is used, in the present invention, for experiments on the human auditory sense with respect to changes in phase. The JND of the phase was previously measured for a zero phase, flat spectrum periodic tone.

The weight assigner 116 controls the amount of quantization noise of each phase by calculating the amount of quantization noise from the perceptual weighting function of each phase calculated by the perceptual weighting function calculator 114. That is, the weight assigner 116 assigns the quantization step size obtained by Equation 9 as a weight to each phase obtained by the phase information extractor 100 (step 320).

The quantization bit assigner 120 assigns a quantization bit to each phase according to the amount of quantization noise controlled through the quantization noise controller 110 (step 330). That is, the quantization bit of each phase is obtained by putting the quantization step size obtained by Equation 9 into Equation 6. The scalar quantizer 130 quantizes each phase by the assigned quantization bit.

An embodiment, in which the perceptual weighting function is calculated by the perceptual weighting function calculator 114, will now be described.

In order to obtain an appropriate perceptual weighting function, psychoacoustic experiments were performed to measure the JND of a phase for a flat spectrum periodic tone with the duration of 512 msec. The signal level was 52 dB/component throughout the experiments and the numbers of harmonics were set to be 39, 26, 19, and 11 for the fundamental frequencies of 100, 150, 200, and 350 Hz, respectively.

FIGS. 4A through 4D show the JNDs of the phases in the respective harmonic frequencies for the harmonic tones having the fundamental frequencies of 100, 150, 200, and 350 Hz. The perceptual weighting function is superimposed on the plot as a solid line. In FIGS. 4A through 4D, a lower JND indicates that the modification of the phase at a corresponding harmonic frequency is quite perceptible to humans. It is noted by experiments that the JND of the phase is quite high at low frequencies, is minimal at a mid-frequency range, and then increases again at high frequencies.

The perceptual weighting function is represented by Equation 10, as the function of a harmonic index k, $$\xi_k = ak^2 + bk + c \tag{10}$$

wherein, a, b, and c are estimated from the measured JND of the phase. Rather than constructing a polynomial suitable for the measured JND, the explicit utilization of some conditions, which was found to be useful for the generation of the weighting function with respect to different fundamental frequencies, was adopted. First, the weighting function $\xi_k$ is defined for $\kappa \leqq k \leqq K$, where K is the maximum harmonic index and κ is the index of a critical phase frequency, which is represented by Equation 11, $$\kappa = \left\lceil Q_{ear}\left(1 - \frac{BW_{\min}}{f_0}\right) - 0.5 \right\rceil \tag{11}$$

wherein, $f_0$, $Q_{ear}$, and $BW_{min}$ represent a fundamental frequency, an asymptotic filter quality at high frequencies, and the minimum bandwidth for low frequency channels. This assumption is reasonable since the phase information below the critical phase frequency was shown to be irrelevant to the perceived quality. Also, the perceptual weighting function is assumed to take its maximum (=1) at κ−1 and K, based on the investigation of the JND measurements for different fundamental frequencies. In addition, the minimum of the perceptual weighting function is empirically determined by the ratio of the minimum JND to the maximum JND.

Table 1 shows listening test results according to the present invention. PQN denotes the percentage of the response showing that the quantization noise, to which the perceptual weighting function is applied, is selected to be equal to or closer to the original signal.

TABLE 1

| | | PQN (%) | |
|---|---|---|---|
| Speaker, Vowel | F0 [Hz] | Δ = 2Π/3 | Δ = 2Π/5 |
| Male, /a/ | 145.5 | 78% | 72% |
| Male, /i/ | 127.0 | 85% | 72% |
| Female, /a/ | 205.1 | 54% | 46% |
| Female, /i/ | 266.7 | 50% | 50% |

From the results, we can see a clear preference for the perceptually weighted quantization noise in male speech. In addition, the smaller Δ means that more bits are assigned in phase information.

The quantization apparatus and method using the perceptual weighting function are described, taking scalar quantization as an example. However, the perceptual weighting function can be used in the distortion metric for vector quantization.

Figure 2:
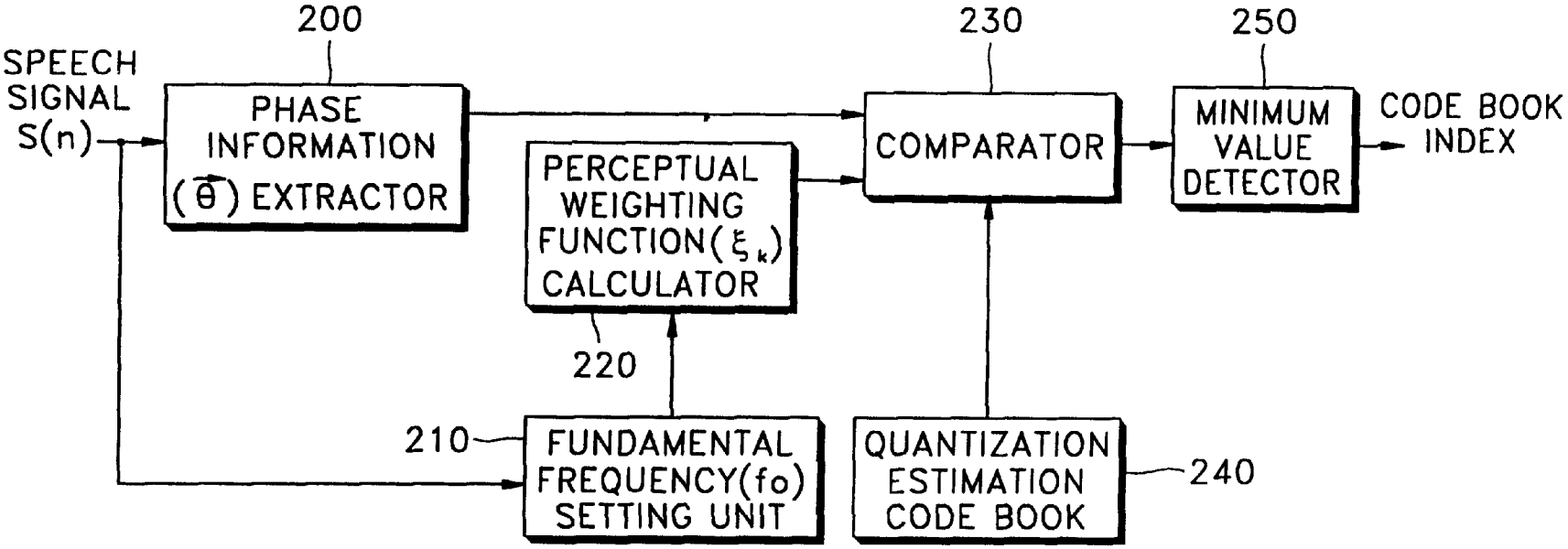
FIG. 2 is a block diagram for describing a phase quantization apparatus according to the present invention for vector quantization.

FIG. 2 is a block diagram for describing the phase quantization apparatus according to the present invention for vector quantization. The phase quantization apparatus includes a phase information extractor 200, a fundamental frequency setting unit 210, a perceptual weighting function calculator 220, a comparator 230, a quantization estimation code book 240, and a minimum value detector 250. Here, description of the members described with reference to FIG. 1 will be omitted.

The comparator 230 compares the previously provided quantization estimation code book 240 with each phase by applying the perceptual weighting function of each phase, calculated by the perceptual weighting function calculator 220. For example, when phase information obtained by the speech signal is represented as $\overline{\theta}=[\theta_1, \theta_2, \ldots, \theta_k]^t$ and one of the phase information items stored in the quantization estimation code book 240 is represented as $\overline{\phi}^i$, the comparator 230 obtains $D(\overline{\theta}, \overline{\phi}^i)$ with respect to input phase information and all phase information items stored in the quantization estimation code book 240. At this time, D is represented as $$D = \sum_k (1 - \xi_k)[\theta_k - \phi_k^i]$$

by adding the perceptual weighting function. The minimum value detector 250 detects the minimum value among the comparison values sequentially obtained by the comparator 230 and outputs the index of the quantization estimation code book 240 corresponding to the minimum value.

As mentioned above, the quality of the encoded speech is improved by quantizing the phase information using the perceptual weighting function.

What is claimed is:

1. An apparatus for quantizing the phase of a speech signal using a perceptual weighting function, comprising:

a phase information extractor for obtaining the phase of each harmonic frequency in a speech signal represented by the discrete sum of periodic signals having different harmonic frequency components;

a quantization noise shaping unit for controlling the amount of quantization noise of each phase using a perceptual weighting function, which makes quantization noise less than a predetermined just noticeable difference (JND) of the phase;

a quantization bit assigner for assigning quantization bits to each phase according to the controlled amount of quantization noise; and a scalar quantizer for quantizing each phase by the assigned quantization bits.

2. The apparatus of claim 1, wherein the quantization noise shaping unit comprises:

a fundamental frequency setting unit for obtaining a fundamental frequency from the speech signal;

a perceptual weighting function calculator for calculating a perceptual weighting function using a result obtained by measuring the JND of the phase in each harmonic frequency with respect to a harmonic tone having the fundamental frequency; and a weight assigner for controlling the amount of quantization noise of each phase by calculating the amount of quantization noise from the perceptual weighting function of each phase.

3. An apparatus for quantizing the phase of a speech signal using a perceptual weighting function, comprising:

a phase information extractor for obtaining the phase of each harmonic frequency in a speech signal represented by the discrete sum of periodic signals having different harmonic frequency components;

a perceptual weighting function calculator for calculating a perceptual weighting function using a result obtained by measuring the JND of the phase at each harmonic frequency for a harmonic tone having the fundamental frequency of the speech signal;

a comparator for comparing a previously provided quantization estimation code book with each phase by applying the perceptual weighting function; and a minimum value detector for detecting the minimum value among comparison values sequentially obtained from the comparator and outputting the index of the quantization estimation code book corresponding to the minimum value.

4. A method for quantizing the phase of a speech signal using a perceptual weighting function, comprising the steps of:

(a) obtaining the phase of each harmonic frequency in a speech signal represented by the discrete sum of periodic signals having different harmonic frequency components;

(b) calculating a perceptual weighting function using a result obtained by the JND of the phase at each harmonic frequency for a harmonic tone having the fundamental frequency of the speech signal;

(c) controlling the amount of quantization noise of each phase by calculating the amount of quantization noise from the perceptual weighting function of each phase;

(d) assigning quantization bits to each phase according to the controlled amount of quantization noise; and (e) quantizing each phase by the assigned quantization bits.

5. The method of claim 4, wherein the perceptual weighting function is represented as a function of a harmonic index k by the following equation in the step (b), $$\epsilon_k = ak^2 + bk + c$$

wherein, a, b, and c are estimated from the JND of a measured phase.

6. The method of claim 4, wherein the amount of quantization noise is represented as a function of a harmonic index k by the following equation in a weight assigner in the step (c), $$\Delta_k = \frac{\xi_k}{\sqrt[K]{\prod_{i=1}^{K} \xi_i}} \Delta$$

wherein, $\epsilon_k$ is a perceptual weighting function and $\Delta$ is a quantization step size.

7. A method for quantizing the phase of a speech signal using a perceptual weighting function, comprising the steps of:

(a) obtaining the phase of each harmonic frequency in a speech signal represented by the discrete sum of periodic signals having different harmonic frequency components;

(b) calculating a perceptual weighting function using the result obtained by measuring the JND of a phase at each harmonic frequency for a harmonic tone having the fundamental frequency of the speech signal;

(c) comparing a previously provided quantization estimation code book with each phase by applying the perceptual weighting function; and (d) detecting the minimum value among the comparison values sequentially obtained in the step (c) and outputting the index of the quantization estimation code book corresponding to the minimum value.

8. The method of claim 7, wherein a perceptual weighting function as the function of a harmonic index k is represented by the following equation in the step (b), $$\epsilon_k = ak^2 + bk + c$$

wherein, a, b, and c are estimated from the JND of the measured phase.

* * * * *